US009876301B2

(12) United States Patent
Zhou

(10) Patent No.: US 9,876,301 B2
(45) Date of Patent: Jan. 23, 2018

(54) ELECTRICAL CONNECTOR FOR CHRISTMAS LAMP TREES

(71) Applicant: Jidai Zhou, Guangdong (CN)

(72) Inventor: Jidai Zhou, Guangdong (CN)

( * ) Notice: Subject to any disclaimer, the term of this patent is extended or adjusted under 35 U.S.C. 154(b) by 0 days.

(21) Appl. No.: 15/482,823

(22) Filed: Apr. 10, 2017

(65) Prior Publication Data

US 2017/0373420 A1 Dec. 28, 2017

(30) Foreign Application Priority Data

Jun. 23, 2016 (CN) ..... 2016 2 0629899 U

(51) Int. Cl.

| | |
|---|---|
| ***H01R 13/17*** | (2006.01) |
| ***H01R 24/86*** | (2011.01) |
| ***F21V 23/06*** | (2006.01) |
| ***F21V 23/04*** | (2006.01) |
| ***H01R 13/627*** | (2006.01) |
| ***H01R 13/24*** | (2006.01) |
| ***H01R 13/213*** | (2006.01) |
| *H01R 107/00* | (2006.01) |

(52) U.S. Cl.

CPC ..... *H01R 13/17* (2013.01); *F21V 23/0407* (2013.01); *F21V 23/06* (2013.01); *H01R 13/213* (2013.01); *H01R 13/2421* (2013.01); *H01R 13/6273* (2013.01); *H01R 24/86* (2013.01); *H01R 2107/00* (2013.01)

(58) Field of Classification Search

CPC ..... H01R 13/17; H01R 13/22; H01R 13/24; H01R 13/213; H01R 13/2407; H01R 13/2414; H01R 13/2421; H01R 13/6273; H01R 24/86; H01R 39/643; H01R 2107/00; F21V 23/06; F21V 23/0407

USPC ..... 439/370, 17, 25, 29, 289, 314

See application file for complete search history.

(56) References Cited

U.S. PATENT DOCUMENTS

| | | | | |
|---|---|---|---|---|
| 3,387,250 A * | 6/1968 | Bjorn | H01R 39/643 | 439/17 |
| 4,445,743 A * | 5/1984 | Bakker | H01R 13/625 | 439/289 |
| 5,899,753 A * | 5/1999 | Wong | H01R 13/2421 | 439/17 |
| 6,162,062 A * | 12/2000 | Liao | H01R 39/643 | 439/17 |

(Continued)

*Primary Examiner* — Tulsidas C Patel
*Assistant Examiner* — Travis Chambers

(57) ABSTRACT

The utility model discloses an electrical connector for Christmas lamp trees which comprises an upper and a lower connecting base, first columnar electrodes and elastic devices are arranged in the upper connecting base, second arc-shaped electrodes are arranged in the lower connecting base, and the elastic devices cause the first electrodes to tightly abut against the second electrodes. The first columnar electrodes and the second arc-shaped electrodes form a point-to-surface contact, so that the reliability of electrical connection is increased greatly, allowing a Christmas lamp tree to be universal to high and low voltages. Moreover, sufficient contact between upper and lower layers and natural effect of the Christmas lamp tree can still be ensured even if the Christmas lamp tree is subjected to an external force, and multiple sets of first and second electrodes are electrically connected in one-to-one correspondence, leading to diversified functions of the Christmas lamp tree.

9 Claims, 7 Drawing Sheets

(56) References Cited

U.S. PATENT DOCUMENTS

| | | | | |
|---|---|---|---|---|
| 7,264,479 | B1 * | 9/2007 | Lee | H01R 11/30 439/39 |
| 7,740,499 | B1 * | 6/2010 | Willey | H01R 13/625 439/289 |
| 9,437,969 | B2 * | 9/2016 | Witter | H01R 13/6205 |
| 9,531,118 | B2 * | 12/2016 | Byrne | H01R 13/2421 |

* cited by examiner

ELECTRICAL CONNECTOR FOR CHRISTMAS LAMP TREES

BACKGROUND OF THE INVENTION

The present utility model belongs to the field of Christmas trees, and particularly relates to an electrical connector for Christmas lamp trees.

As one important motif of Christmas, modern Christmas trees originated in Germany, which gradually became popular all over the world and became one of the most famous traditions of Christmas celebration.

Assemblable Christmas trees have an enormous market since they are convenient to disassemble and facilitate packaging and transportation. An assemblable Christmas tree mainly comprises a base, a trunk column, branches, and colored lamps, the trunk column is arranged on the base column and is normally composed of two or more hollow tubes connected by insertion for convenient storage and transportation, the branches are arranged on each tube, and the colored lamps are arranged on the branches. However, existing power connectors for Christmas trees generally have the defects of low electrical connection reliability and unstable connection. For instance, Chinese patent CN201520263594.5 discloses a power connector for Christmas trees of a combined structure, in which the electrical contact connection means between a first conductive ring and a second conductive ring is described. The reliability of such an electrical connection means is low, and the single electrical connection means between the first conductive ring and the second conductive ring is only capable of providing a single function of electrical connection. Chinese patent CN201520655520.6 discloses a connector assembly for assemblable Christmas trees, in which the electrical connection is realized through the contact between conductive connecting plates on an upper base and a lower base which are inserted into each other. This connection means is also low in reliability and fails to afford versatility in function, i.e., still provides a single function.

BRIEF SUMMARY OF THE INVENTION

In view of the above defects of the prior art, the technical problem to be solved by the present utility model is to provide an electrical connector for Christmas lamp trees to solve the defects of low electrical connection reliability, unstable connection and undiversified lamp function existing in connectors for Christmas lamp trees of the prior art.

The technical solution adopted to solve the technical problem by the present utility model is as follows. Provided is an electrical connector for Christmas lamp trees, which comprises an upper connecting base and a lower connecting base, at least one first columnar electrode is arranged in the upper connecting base, at least one second arc-shaped electrode that is in contact with the first electrode is arranged in the lower connecting base, and an elastic device which is used to provide elastic force so as to allow the first electrode to tightly abut against the second electrode is also arranged in the upper connecting base.

A further preferred embodiment of the present utility model is as follows. The upper connecting base comprises a receiving groove with an opening at the upper end and a cover plate arranged above the receiving groove, and the elastic device is arranged in the receiving groove; one end of the first electrode runs through a bottom surface of the receiving groove to be in contact with the second electrode, and the other end is connected to the elastic device.

As a further preferred embodiment of the present utility model, the elastic device is a compression spring which abuts between against the cover plate and the first electrode in between.

As a still further preferred embodiment of the present utility model, the second electrode comprises an arc-shaped polar plate and connecting pins arranged on the arc-shaped polar plate; and the first electrode comprises a contact end in contact with the arc-shaped polar plate of the second electrode, a wire-connecting end for connection with a wire, and a raised ring for abutting against the compression spring.

As a still further preferred embodiment of the present utility model, the interior of the lower connecting base is provided with an electrode groove which matches with the arc-shaped polar plate in shape.

As a still further preferred embodiment of the present utility model, each set of first and second electrodes are connected electrically to a functional module, a plurality of electrical circuits are formed by the contact ends and the arc-shaped polar plates through contact therebetween, the electrical circuits are connected to the functional modules capable of being switched freely, and the functional modules include a constant shining effect module, a trotting horse effect module, a colored lamp module and a clear light module.

As a still further preferred embodiment of the present utility model, the electrical connector for Christmas lamp trees also comprises a fixing structure for fixing the upper connecting base and the lower connecting base.

As a still further preferred embodiment of the present utility model, the fixing structure comprises clamping buckles arranged on the upper connecting base and clamping grooves arranged on the lower connecting base and matching the clamping buckles.

As a still further preferred embodiment of the present utility model, each clamping buckle comprises a boss, and each clamping groove comprises a clamping buckle passage and a blocking border for blocking the clamping buckle.

The present utility model has the following advantages that the first columnar electrode and the second arc-shaped electrode form a point-to-surface contact, and the elastic device arranged in the upper connecting base provides the elastic force to allow the first electrode to tightly abut against the second electrode for sufficient contact, so that the reliability of electrical connection is increased greatly, and the electrical connector for Christmas lamp trees can be universal to high voltage and low voltage. Moreover, the steady connection between the clamping buckles and the clamping grooves allows a more stable locked stat, and sufficient contact between upper and lower layers and the natural effect of the Christmas lamp tree can be ensured even if the Christmas lamp tree is subjected to an external force. Furthermore, since the multiple sets of first and second electrodes are connected electrically to different functional modules, the monotony of function of the prior art can be avoided, thus leading to a Christmas lamp with diversified functions.

BRIEF DESCRIPTION OF THE DRAWINGS

The present utility model is further described below with reference to embodiments and drawings, in which.

DETAILED DESCRIPTION OF THE INVENTION

Preferred embodiments of the present utility model are described in detail below with reference to the drawings.

Embodiment 1

Figure 1:
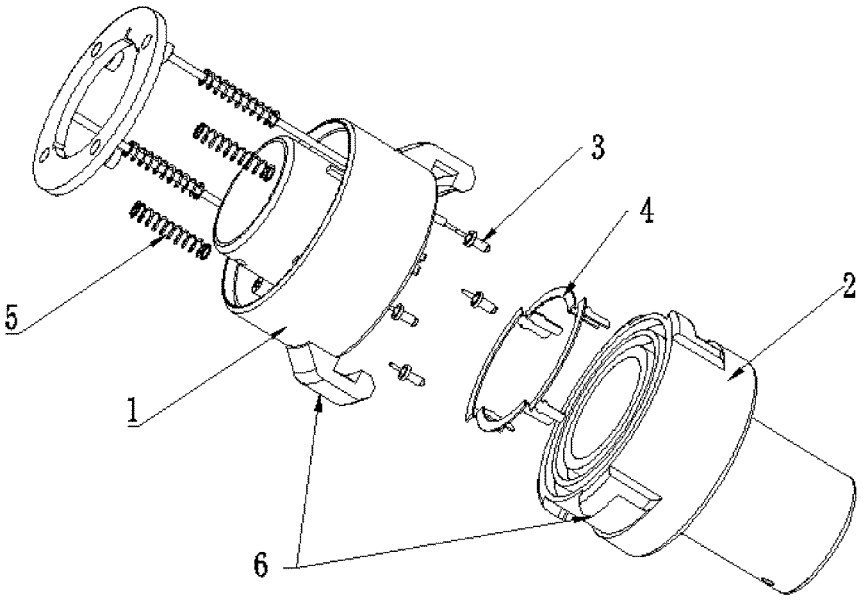
FIG. 1 is an exploded diagram of an electrical connector for Christmas trees of embodiment 1 of the present utility model.
Figure 2:
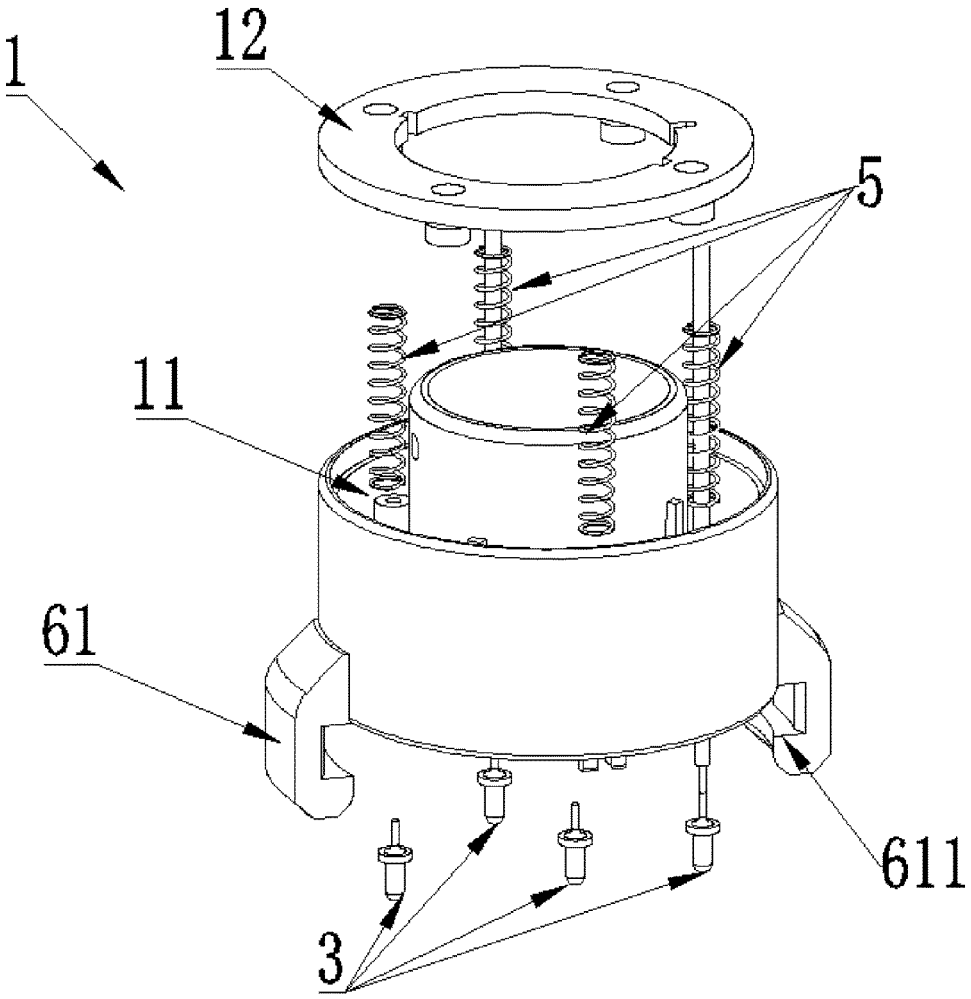
FIG. 2 is an exploded schematic diagram of an upper connecting base of embodiment 1 of the present utility model.
Figure 3:
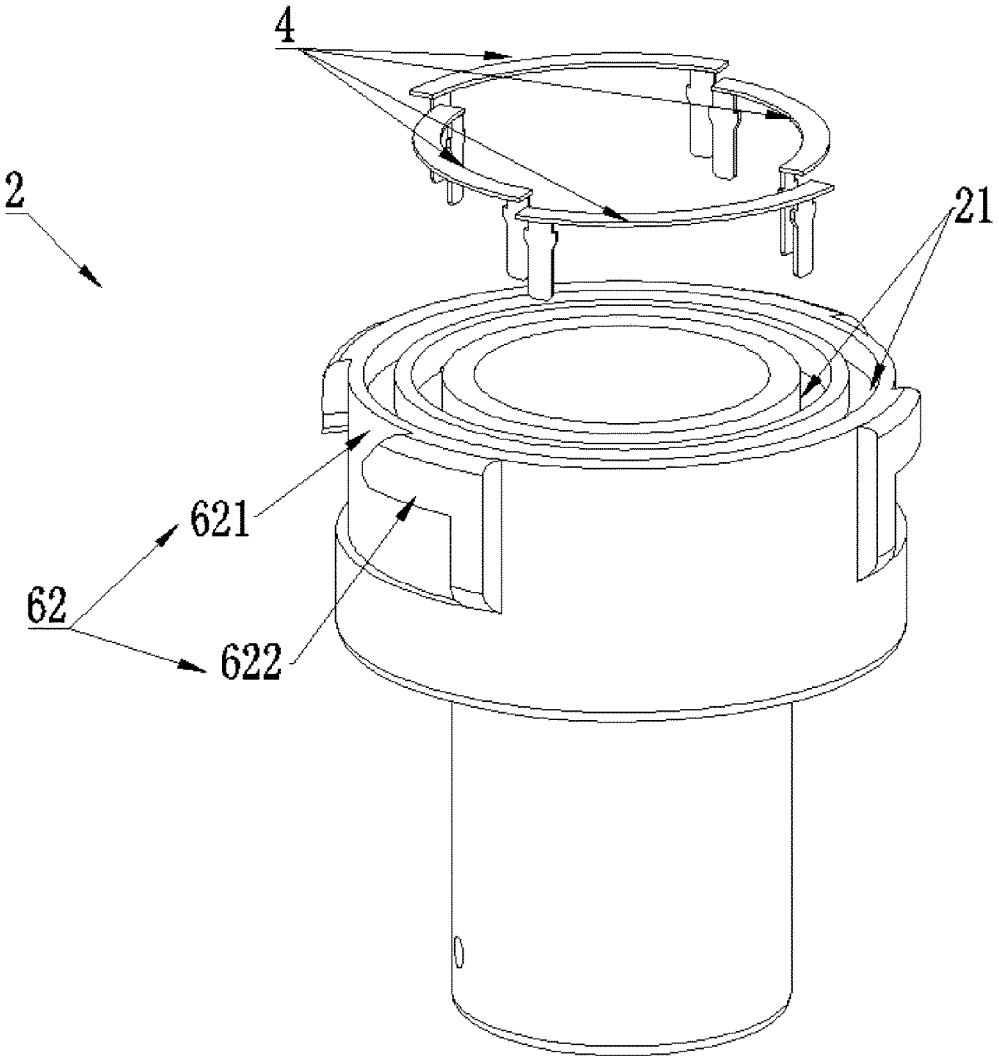
FIG. 3 is a three-dimensional structural schematic diagram of a lower connecting base of embodiment 1 of the present utility model.
Figure 4:
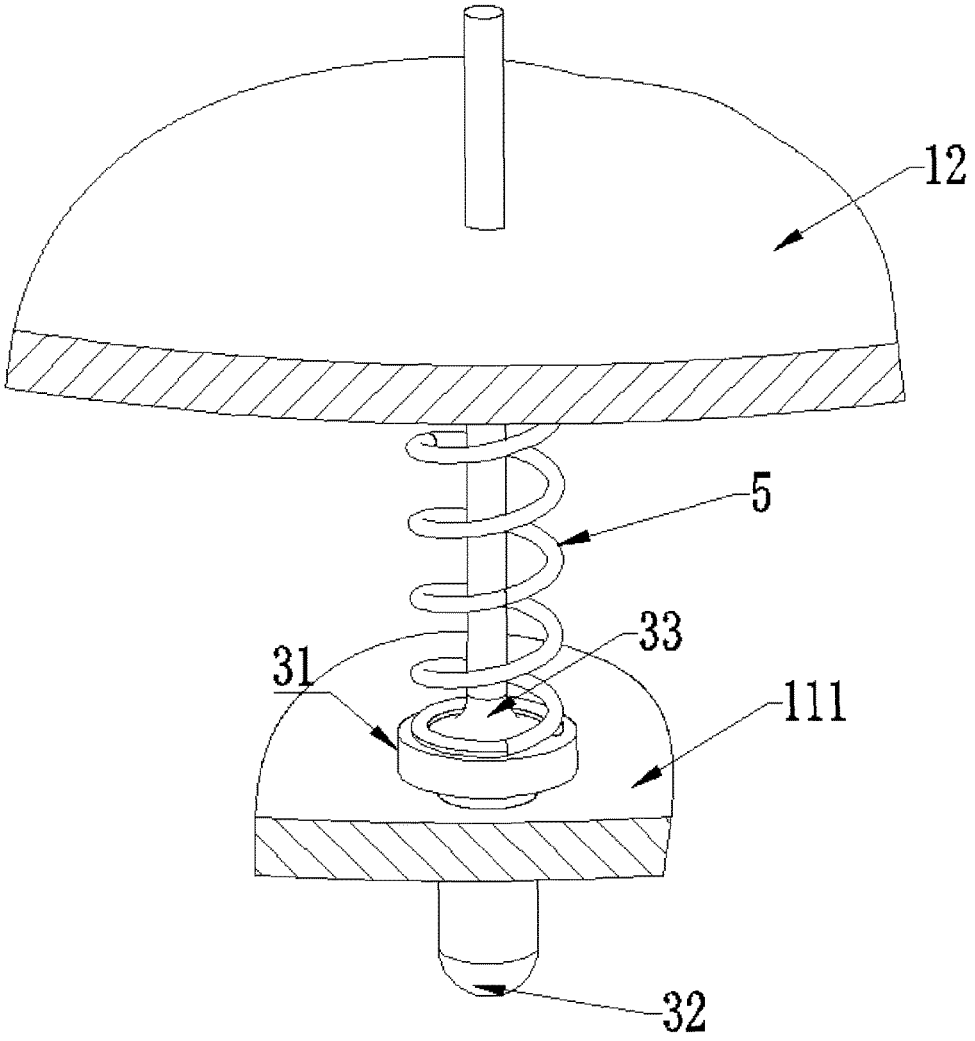
FIG. 4 is a schematic diagram of the elastic devices and first electrodes in an assembled state of embodiment 1 of the present utility model.

As shown in FIGS. 1-3, an electrical connector for Christmas lamp trees of the present embodiment comprises an upper connecting base 1 and a lower connecting base 2, first columnar electrodes 3 are arranged in the upper connecting base 1, second arc-shaped electrodes 4 that are in contact with the first electrodes 3 are arranged in the lower connecting base 2, and elastic devices 5 which are used to provide elastic force so as to allow the first electrodes 3 to tightly abut against the second electrodes 4 are also arranged in the upper connecting base 1. The first columnar electrodes 3 and the second arc-shaped electrode 4 form a point-to-surface contact, and the elastic devices 5 arranged in the upper connecting base 1 provide the elastic force to allow the first electrodes 3 to tightly abut against the second electrode 4, so that the reliability of electrical connection is increased greatly, and the electrical connector for Christmas lamp trees can be universal to high voltage and low voltage As shown in FIGS. 2-4, the upper connecting base 1 of the present embodiment comprises a receiving groove 11 with an opening at the upper end and a cover plate 12 arranged upon the receiving groove 11, and the elastic devices 5 are arranged in the receiving groove 11; one end of each first electrode 3 runs through a bottom surface 111 of the receiving groove 11 to be in contact with one second electrode 4, and the other end is connected to one elastic device 5. The elastic devices 5 can be springs, elastic pieces, elastic rubber pads or the like. The elastic devices 5 of the present embodiment are compression springs which abut between the cover plate 12 and the first electrodes 3. In order to cooperate with the compression springs, each first electrode 3 is provided with a raised ring 31 which has a periphery diameter not less than of the raised ring 31 is not less than the diameter of the compression spring, thereby providing a point of force application for the compression spring.

Figure 5:
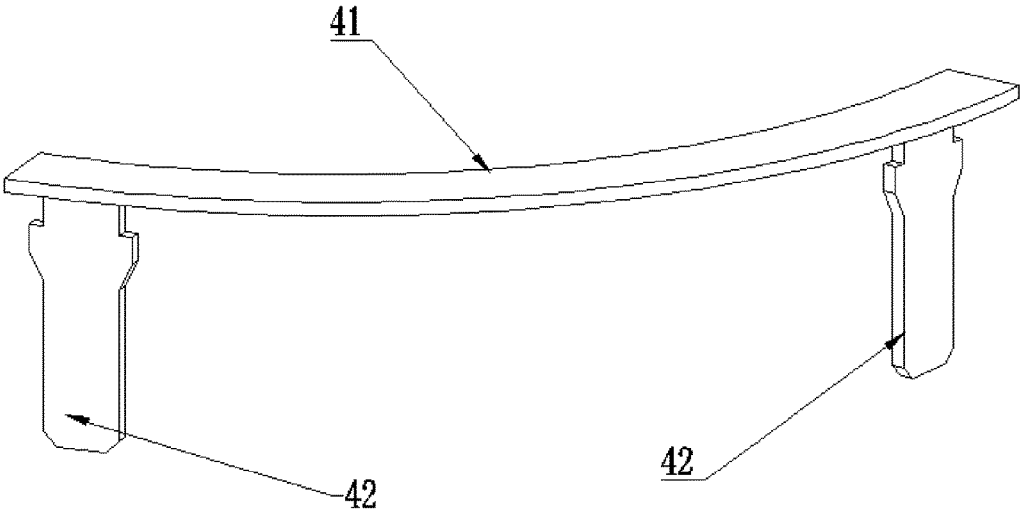
FIG. 5 is a three-dimensional structural schematic diagram of a second electrode of embodiment 1 of the present utility model.

As shown in FIGS. 4-5, each second electrode 4 of the present embodiment comprises an arc-shaped polar plate 41 and connecting pins 42 arranged on the bottom of the arc-shaped polar plate 41; and each first electrode 3 comprises a contact end 32 in contact with the arc-shaped polar plate 41 of the second electrode 4, a wire-connecting end 33 for connection with a wire, and the raised ring 31 for abutting against the compression spring. The arrangement of the arc-shaped polar plates 41 enlarges the conductive area of the second electrodes 4, so that a good contact between the contact ends 32 and the second electrodes 4 can still be kept even if the former move due to the shake and swing of the Christmas lamp tree, helping to increase the stability of electrical connection. Further, in order to fix and prevent the second electrodes 4 from shaking, the interior of the lower connecting base 2 is provided with electrode grooves 21 which are adapted to the shape of the arc-shaped polar plates 41, and during assembly, the arc-shaped polar plates 41 are clamped in the electrode grooves 21.

As shown in FIGS. 1-5, in the present embodiment, there are four first electrodes 3, and accordingly four second electrodes 4, thus each set of the first electrode 3 and second electrode 4 electrically connected to each other can realize a function. In the present embodiment, there are four sets of the first electrodes 3 and second electrodes 4, and a plurality of electrical circuits are formed by the contact ends and the arc-shaped polar plates through the contact therebetween. The electrical circuits are connected to functional modules (not shown) capable of being switched freely, and the functional modules include a constant shining effect module, a trotting horse effect module, a colored lamp module and a clear light module, thus the free switching between the above functional modules can be realized. The above functional modules also include all other functional connection modules and are not limited by the number of the first electrodes 3 and the second electrodes 4, and therefore can be designed freely according to the diversification of the functional connection modules. In this way, the plurality of first electrodes 3 and second electrodes 4 are in one-to-one correspondence, the monotony of the prior art can be avoided, and the functions of Christmas lamps on the Christmas tree can be switched, and thus are diversified.

As shown in FIGS. 1-3, in order to further increase the reliability of electrical connection between the first electrodes 3 and the second electrodes 4 and to ensure the sufficient contact between upper and lower layers and the natural effect of the Christmas tree even if the Christmas lamp tree is subjected to an external force, the electrical connector for Christmas lamp trees in the present embodiment also comprises a fixing mechanism for fixing the upper connecting base 1 and the lower connecting base 2. The fixing mechanism can be a magnetic attraction mechanism arranged on the upper connecting base 1 and the lower connecting base 2 and provided with opposite polarities, or a threaded connection mechanism arranged on the upper connecting base 1 and the lower connecting base 2, or a mechanism of clamping buckles 61 arranged between the upper connecting base 1 and the lower connecting base 2. The present embodiment adopts the mechanism of the clamping buckles 61, and the fixing mechanism comprises the clamping buckles 61 arranged on the upper connecting base 1 and clamping grooves 62 arranged on the lower connecting base 2 and matching the clamping buckles 61. Each clamping buckle 61 comprises a boss 611, and each clamping groove 62 comprises a clamping buckle passage 621 and a blocking border 622 for blocking the boss 611 of the clamping buckle 61. During assembly, the clamping buckles 61 are inserted into the clamping grooves 62 via the clamping buckle passages 621, the upper connecting base 1 is then rotated, so that the clamping buckles 61 are staggered from the clamping buckle passages 621, at this moment, the bosses 611 and the blocking borders 622 abut against each other, and thus the upper connecting base 1 and the lower connecting base 2 are fixed. After the upper connecting base 1 and the lower connecting base 2 are fixed together, the point-to-surface electrical connection between the first electrodes 3 and the second electrodes 4 is more reliable. Specifically, in the present embodiment, the clamping buckle passage 621 is arranged at the middle of the clamping groove 62, and therefore it is ensured that the upper connecting base 1 and the lower connecting base 2 can be fixed together no matter whether the upper connecting base 1 is rotated relative to the lower connecting base 2 clockwise or counterclockwise. Preferably, the arc-shaped polar plate 41 of each second electrode 4 in the present embodiment has an appropriate length which ensures that the contact ends 32 of the first electrodes 3 just abut against the middles of the arc-shaped polar plates 41 of the second electrodes 4 when the clamping buckles 61 are inserted into the clamping grooves 62 via the clamping buckle passages 621, and that the contact ends 32 of the first electrodes 3 still abut against the arc-shaped polar plates 41 of the second electrodes 4 when the upper connecting base 1 is rotated to the ultimate position of both ends of the clamping grooves 62.

Embodiment 2

Figure 6:
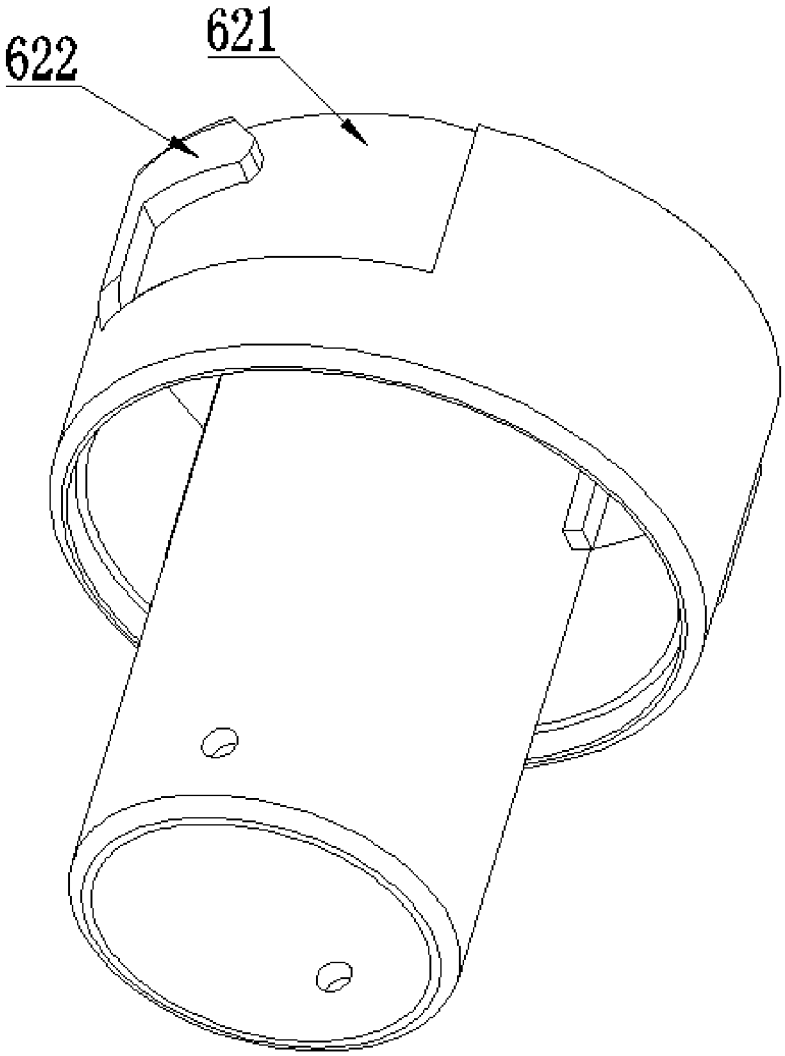
FIG. 6 is a three-dimensional structural schematic diagram of the lower connecting base of embodiment 2 of the present utility model.

As shown in FIG. 6, the overall structure of the present embodiment is the same as that of embodiment 1, and the differences lie in that the clamping buckle passage 621 is arranged at the end of the clamping groove 62, the upper connecting base 1 can only be rotated relative to the lower connecting base 2 in one direction, and after rotation, both can be fixed. At this point, the arc-shaped polar plate 41 of the second electrode 4 has a length shorter than that of the arc-shaped polar plate 41 of embodiment 1; when the clamping buckles 61 are inserted into the clamping grooves 62 via the clamping buckle passages 621, the contact ends 32 of the first electrodes 3 are not in contact with the arc-shaped polar plates 41 of the second electrodes 4; while when the upper connecting base 1 is rotated gradually to the ultimate position of the ends of the clamping grooves 62, the contact ends 32 of the first electrodes 3 abut against the arc-shaped polar plates 41 of the second electrodes 4.

Embodiment 3

Figure 7:
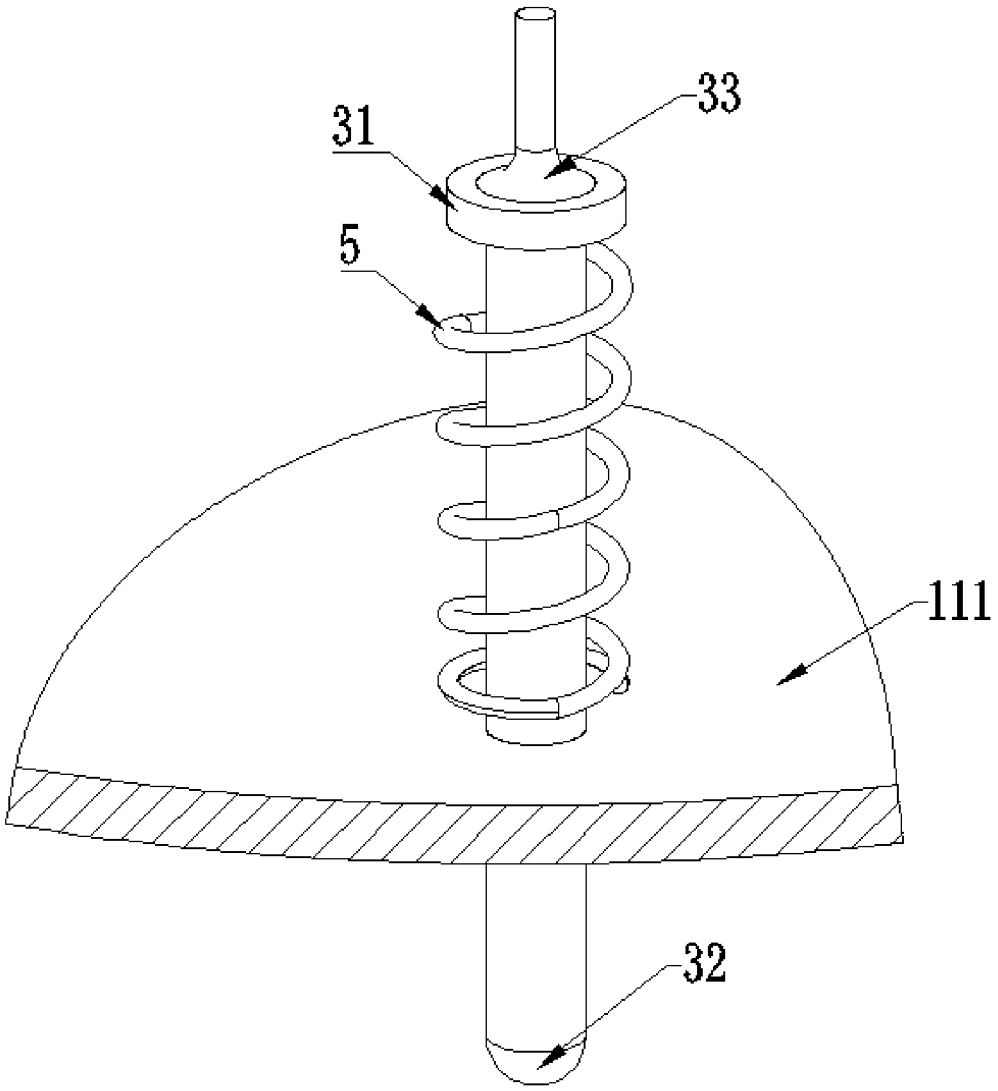
FIG. 7 is a schematic diagram of elastic devices and first electrodes in an assembled state of embodiment 3 of the present utility model.

As shown in FIG. 7, the overall structure of the present embodiment is the same as that of embodiment 1, and the differences lie in that the elastic devices 5 are tension springs which are arranged between the bottom surface 111 of the receiving groove 11 and the lower surfaces of the raised rings 31 of the first electrodes 3.

It should be understood that the above embodiments are merely used to describe the technical solution of the present utility model rather than limit it, and for those skilled in the art, the technical solution described in the above-mentioned embodiments can be modified, or part of the technical features can be replaced equivalently; and all these modifications and replacements shall fall within the protection scope of the claims.

What is claimed is:

1. An electrical connector for Christmas lamp trees, comprising an upper connecting base and a lower connecting base, and characterized in that at least one first columnar electrode is arranged in the upper connecting base, at least one second arc-shaped electrode that is in contact with the first electrode is arranged in the lower connecting base, and an elastic device which is used to provide elastic force so as to allow the first electrode to tightly abut against the second electrode is also arranged in the upper connecting base;

the upper connecting base comprises a receiving groove with an opening at the upper end and a cover plate arranged upon the receiving groove;

the first electrode comprises a raised ring which has a periphery diameter not less than a diameter of the elastic device:

the elastic device is arranged in the receiving groove, having one end abutting against the cover plate and another end butting a top surface of the raised ring.

2. The electrical connector for Christmas lamp trees according to claim 1, characterized in that the contact end of each set of first electrode is in contact with the arc-shaped polar plate of the second electrode to form an electrical circuit, and the circuit is selectively connected to one of various functional modules which comprises a constant shining effect module, a trotting horse effect module, a colored lamp module and a clear light module.

3. The electrical connector for Christmas lamp trees according to claim 1, characterized in that a bottom end of the first electrode runs through a bottom surface of the receiving groove to be in contact with the second electrode.

4. The electrical connector for Christmas lamp trees according to claim 3, characterized in that the elastic device is a compression spring.

5. The electrical connector for Christmas lamp trees according to claim 4, characterized in that the second electrode comprises an arc-shaped polar plate and connecting pins arranged on the bottom of the arc-shaped polar plate; and the first electrode further comprises a contact end in contact with the arc-shaped polar plate of the second electrode, and a wire-connecting end for connection with a wire.

6. The electrical connector for Christmas lamp trees according to claim 5, characterized in that the interior of the lower connecting base is provided with an electrode groove which matches the shape of the arc-shaped polar plate.

7. The electrical connector for Christmas lamp trees according to claim 1, characterized by also comprising a fixing mechanism for fixing the upper connecting base and the lower connecting base.

8. The electrical connector for Christmas lamp trees according to claim 7, characterized in that the fixing mechanism comprises clamping buckles arranged on the upper connecting base and clamping grooves arranged on the lower connecting base and matching the clamping buckles.

9. The electrical connector for Christmas lamp trees according to claim 8, characterized in that each clamping buckle comprises a boss, and each clamping groove comprises a clamping buckle passage and a blocking border for blocking the clamping buckle.

* * * * *